US010415325B2

(12) United States Patent
Newman

(10) Patent No.: US 10,415,325 B2
(45) Date of Patent: Sep. 17, 2019

(54) MONOLITHIC BLADE STABILISER TOOL FOR DRILL STRING

(71) Applicant: EUROPEAN DRILLING PROJECTS B.V. (NL), Heerhugowaard (NL)

(72) Inventor: Michael Thomas Newman, Tuijehoorn (NL)

(73) Assignee: European Drilling Projects B.V. (NL), Heerhugowaard (NL)

( * ) Notice: Subject to any disclaimer, the term of this patent is extended or adjusted under 35 U.S.C. 154(b) by 0 days.

(21) Appl. No.: 15/258,284

(22) Filed: Sep. 7, 2016

(65) Prior Publication Data

US 2017/0074054 A1 Mar. 16, 2017

(30) Foreign Application Priority Data

Sep. 14, 2015 (EP) ..... 15185136

(51) Int. Cl.
*E21B 17/10* (2006.01)
*E21B 10/30* (2006.01)

(52) U.S. Cl.
CPC ..... *E21B 17/1078* (2013.01); *E21B 10/30* (2013.01)

(58) Field of Classification Search
CPC .. E21B 17/1078; E21B 17/10; E21B 17/1085; E21B 17/16; E21B 10/30
See application file for complete search history.

(56) References Cited

U.S. PATENT DOCUMENTS 1,912,854 A * 6/1933 Osgood ..... E21B 10/02 175/325.2
8,205,687 B2 * 6/2012 Radford ..... E21B 17/1078 175/325.1
2006/0201670 A1 * 9/2006 Stewart ..... E21B 17/1078 166/241.6
2011/0198090 A1 * 8/2011 Buytaert ..... E21B 21/00 166/309

FOREIGN PATENT DOCUMENTS

EP 1650400 A1 * 4/2006 ..... E21B 17/10

* cited by examiner

*Primary Examiner* — Taras P Bemko
*Assistant Examiner* — Jonathan Malikasim
(74) *Attorney, Agent, or Firm* — Rankin, Hill & Clark LLP

(57) ABSTRACT

A drilling string stabilizer tool comprises a cylindrical body and a plurality of stabilizer blades machined as an integral component forming in this way a monolithic blade stabilizer tool. The stabilizer blades have an elongated shape and are aligned in the direction of the axis of the cylindrical body. The blades are disposed in such a way to result in an almost constant flow-by-area.

7 Claims, 8 Drawing Sheets

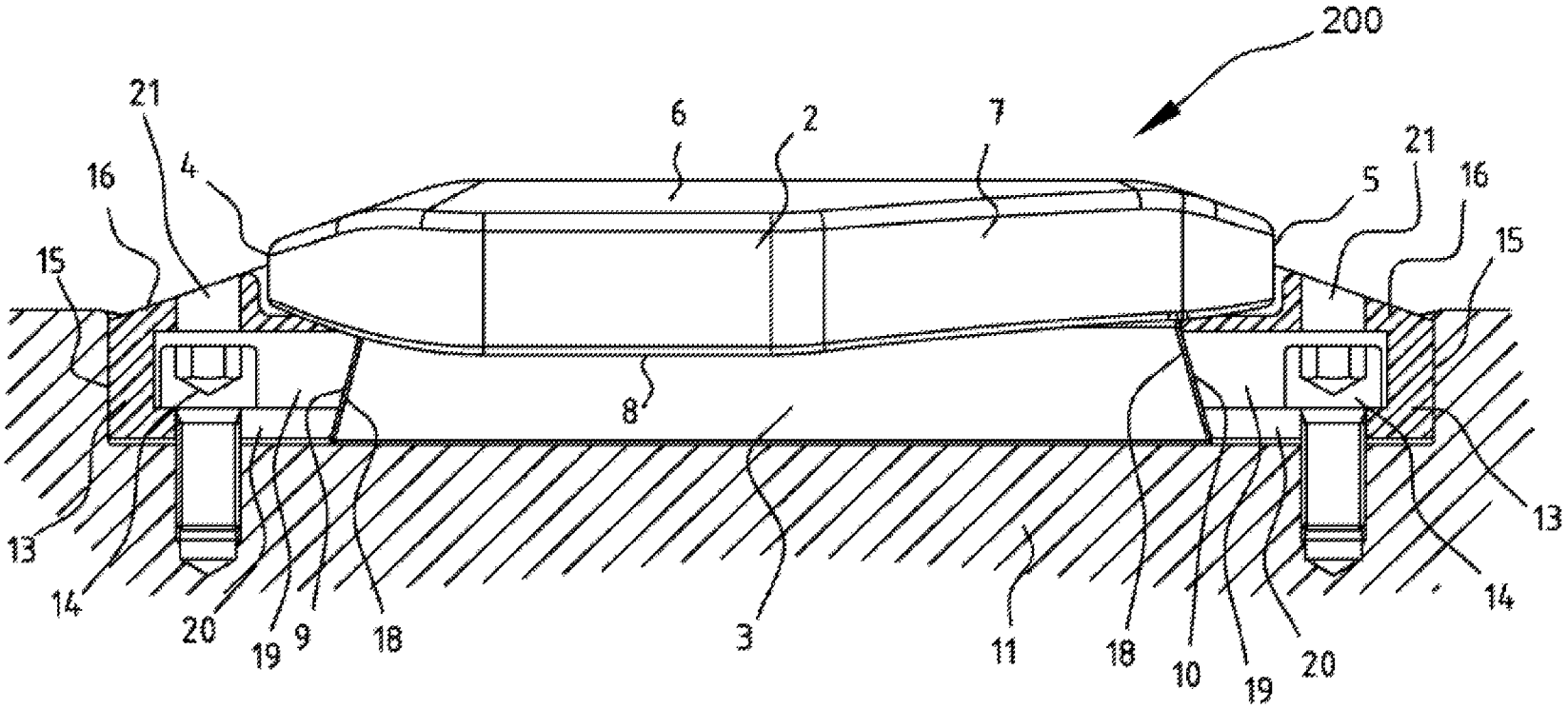
Fig.2
(PriorArt)

MONOLITHIC BLADE STABILISER TOOL FOR DRILL STRING

FIELD OF THE INVENTION

The present invention relates to a monolithic blade stabiliser tool used for stabilising the operation of a drill string when drilling oil, gas, or geothermal wells.

STATE OF THE ART

In directional drilling it is very important to maintain full control of the operations. To maintain control of the drill string, it is known to use a certain number, normally two or three, of so called drilling stabiliser tools placed in the bottom hole assembly.

The primary function of the stabilisers in the drilling string is to support and stabilise the bottom hole assembly in the borehole through the earth surface. The stabiliser should also provide stability when weight is applied or buffeting occurs caused by vibration and shock loads being transmitted through the drill string. An example of a drilling string bottom hole assembly configuration 100 with two stabiliser tools 200 is shown in FIG. 1. A stabiliser tool 200 comprises a cylindrical stabiliser body and a plurality of stabiliser blades 1 made of high-strength steel located on the outer surface of said cylindrical stabiliser body. The blades can be either straight or spiralled with hard surface for wear resistance. The design of the stabiliser blades should be such that they reduce both friction and drag in the borehole during all phases of the drilling operations, thus preventing the well-known problems such as damage to the borehole, balling up and borehole instability. In addition the stabiliser tool should not inhibit the drilled cuttings being carried out of the hole by the drilling fluid. The contact area of the blades should be large enough to adequately support the drill string in the borehole while minimising or eliminating penetration of the borehole wall.

The blades can be screwed to the body thus making the blades replaceable. EP1650400 describes a drilling string stabiliser tool having replaceable stabiliser blades. The stabiliser blade assembly comprises mounting blocks having holes for mounting the blocks on the stabiliser body with bolts. The stabiliser blades 1 are shown in FIG. 2 mounted onto the cylindrical stabiliser body 11. The cylindrical surface of the stabiliser body is provided with axially aligned mounting slots 15.

The stabiliser blade comprises an upper stabilising part 2 and a lower downwards projecting mounting part 3. The downwards projecting mounting part 3 has tapered front 9 and back 10 walls to mate with the matching tapered part of mounting blocks 13 that are secured to the stabiliser body by bolts.

When the two tapered mounting blocks 13 are tightened into position, the pressure exerted between the tapered mounting blocks and the tapered downwards projecting mounting part 3 of the stabiliser blade in the recess locks the entire assembly in place.

Although this configuration has shown to be working in a satisfactory manner, it led to severe failure when the forces into play reach certain threshold values.

Unwanted vibrations that may be realised during drilling, such as axial, lateral (whirl), and torsional (stick slip) can damage the tool. In case of impact forces higher than certain threshold values some of the blades can be forced out of their recesses and the blocks that secure the blade to the body can suffer severe damages. A solution to these problems is to provide some improvements to the mounting of the blades. FIGS. 3 and 4 describe another design for a stabiliser tool with replaceable blades.

This stabiliser tool (FIG. 3) comprises a cylindrical body 20 defining a longitudinal axis X and having on its surface a plurality of longitudinal grooves 14 each with a respective pin 13, extending radially from the bottom surface inside the grooves 14 as an integral part of the cylindrical body 20, and a plurality of equal stabiliser blades.

The stabiliser blade 1', described in FIG. 4, has an integral mounting part, i.e. for the assembly of the stabiliser tool there are no separated mounting blocks. The blade 1' has an elongated shape defining a longitudinal axis. It comprises an upper stabilising part 2, placed radially distally from the longitudinal axis X of said cylindrical body 20 when mounted, and a lower mounting part 3, placed radially proximally from said longitudinal axis X. The lower mounting part 3 has a recessed longitudinal slot to engage the corresponding pin 13 protruding from the bottom surface of the groove 14, generally formed by a milling operation, into the surface of the cylindrical body 20. The stabiliser blade 1' is secured in the groove 14 by means of bolts. A rectangular peripheral area 15 at the front part of the lower mounting part 3 and a triangular one 16 at the back part of the lower mounting part 3 will accommodate respectively three holes 17 and one hole 17 for the mounting bolts. Three holes are formed also in the front (or lead) rectangular periphery of the groove 14 and one in the rear (or back) triangular periphery. In this manner the stabiliser blade is fully imbedded in the cylindrical body 20 resulting in better hydrodynamic performances, furthermore the loads acting on it are evenly distributed to the structure of the cylindrical body 20 by means of the contact existing with the central pin 13 and with the walls of the groove 14. By the introduction of the pin it is possible to reach a better evenly distribution of the loads, and mainly avoid overloading of the bolts. Other advantages are a greater surface contact area and a wider foot print that results in an improved stability.

There are cases where it is advisable to avoid the use of replaceable blades and employ instead a monolithic type of blade stabiliser tool for drill string, with a principal benefit being no risk of bolt or blade loss, due to the challenges faced when scaling down tools for example.

There are approximately 5000 rigs (land and offshore) in total worldwide, of which activity levels are strongly linked to the oil price and market demands. Therefore, several stabiliser tool design types are required to cover the whole range of drilling applications, rock formations, and environments. As such, both a monolithic and replaceable blades type stabiliser tool design should be available.

The choice of specific type of blade stabiliser tool for drilling depends on the hardness of the rock formation, which can be subdivided in: soft to medium-soft formation (shale, clay, limestone, sand); medium-hard to hard formation (hard limestone, sandstone, dolomite); and hard and abrasive formations (granites, basalts, quartzite and chert). When drilling hard and abrasive formations such as chert formations, it is very easy to damage the blades, therefore the ability to replace blades on the rig site is the preferred solution, whereas for soft to medium-soft formations, such as clay formations, there is less need to replace blades, thus a monolithic stabiliser tool can be used.

The decision of choosing certain stabiliser tool type for drilling could also be application (land, offshore drilling) or geographically-related. For example, in land drilling it would not be recommended to use a tool with replaceable blades, because of the lower costs associated with land drilling. The drilling of geothermal wells requires lower costs still. In applications such as drilling vertical holes where the outer diameter requirements of the stabiliser are known, as well as, drilling tangent and horizontal hole sections in combination with rotary steerable systems, or steerable motor assemblies, where also the outer diameter requirements of the tool are known, the use of a monolithic stabiliser tool is also recommended and justifiable. Additionally, in some areas like Africa and Russia where drilling costs are low, the use of a tool with replaceable blades is not justifiable too.

Therefore, to meet market demands and to be able to cope with all types of different applications, rock formations and environments, it is also necessary to design a monolithic stabiliser tool for drill strings, which is more cost-effective to manufacture, while at the same time has at least the same performance as the one with replaceable blades.

SUMMARY OF THE INVENTION

It is the object of the present invention to provide a monolithic stabiliser tool for drilling strings that overcomes the aforementioned problems and has a higher resistance to impacts, a better hydrodynamic performance in operation and is cost-effective.

These aims are achieved by a monolithic stabiliser tool for a drilling string comprising, according to claim 1, a cylindrical body part of radius "r" and length L defining a longitudinal axis X and comprising a plurality of stabiliser blades wherein said stabiliser blades and said cylindrical body part are machined as an integral component forming in this way a monolithic blade stabiliser tool, said stabiliser blades extending radially outwardly from the surface of said cylindrical body part, and defining with their most outwardly extended surface an ideal cylinder coaxial with said cylindrical body part and having a radius R>r; each of said stabiliser blades having an elongated shape extending parallel to said longitudinal axis X and having length l<L; each of said stabiliser blades comprising a front section, a back section and a central section, an upper surface having the shape of a dome defining the contact area, and side walls, wherein said back section tapers from said central section towards a substantially semi-circular back end, while the front section has substantially the shape of a semicircle, and wherein said upper surface of the stabiliser blade slopes downwards near and towards the end of the front section and also near and towards the end of the back section till it meets the surface of said cylindrical body part.

Thanks to these features, the monolithic stabiliser tool has improved properties, in particular with respect to friction, hydrodynamics, and use, as well as lower maintenance and manufacturing costs. The tool is ideal for drilling in specific formations environments, and applications such as geothermal wells, drilling on land, and in some specific geographic and geologic areas.

Advantageously the positioning of the stabiliser blades (three or more lower and three or more upper stabiliser blades) are suitably positioned to optimize the hydrodynamic efficiency of the tool. Said positioning also assists in streamlining the mud flow around the stabiliser blades, minimising the restriction of cuttings being carried out of the hole and enhancing hole cleaning, while maintaining all round centralisation of the bottom hole assembly in the borehole.

Advantageously the stabiliser blade has a large surface contact area. The toe and heel angle of the stabiliser blades are preferably machined at approximately 20°.

Advantageously the free flow area between the stabiliser blades, can be kept as constant as possible.

Advantageously the blades have a dome shaped contact area.

Advantageously the blades have a hard surface for wear resistance.

Furthermore, the necessary flow paths are created by milling the cylindrical body, while shaping the stabiliser blades. In this manner, the flow-by-area is more constant than the one of the stabiliser tool with replaceable blades.

The monolithic stabiliser tool of the invention can withstand more lateral/axial loads, and more side loads than the solutions of the state of the art and, further, the monolithic stabiliser tool reduces the possibility of balling up or pack off, also mitigating causes of lost circulation or well control risk.

BRIEF DESCRIPTION OF THE DRAWINGS

Further features and advantages of the invention will be more apparent in light of the detailed description of preferred, but not exclusive, embodiment, of a drilling string stabiliser illustrated by way of a non-limitative example, with the aid of the accompanying drawings, in which:

FIG. 2 is a perspective view of a stabiliser blade according to the state of the art;

FIG. 9 shows the flow-by-area percentage in monolithic stabiliser tool compared with a stabiliser tool having replaceable blades (as the one depicted in FIG. 3).

The same reference numbers in the drawings identify the same elements or components.

DETAILED DESCRIPTION OF PREFERRED EMBODIMENTS

Figure 5:
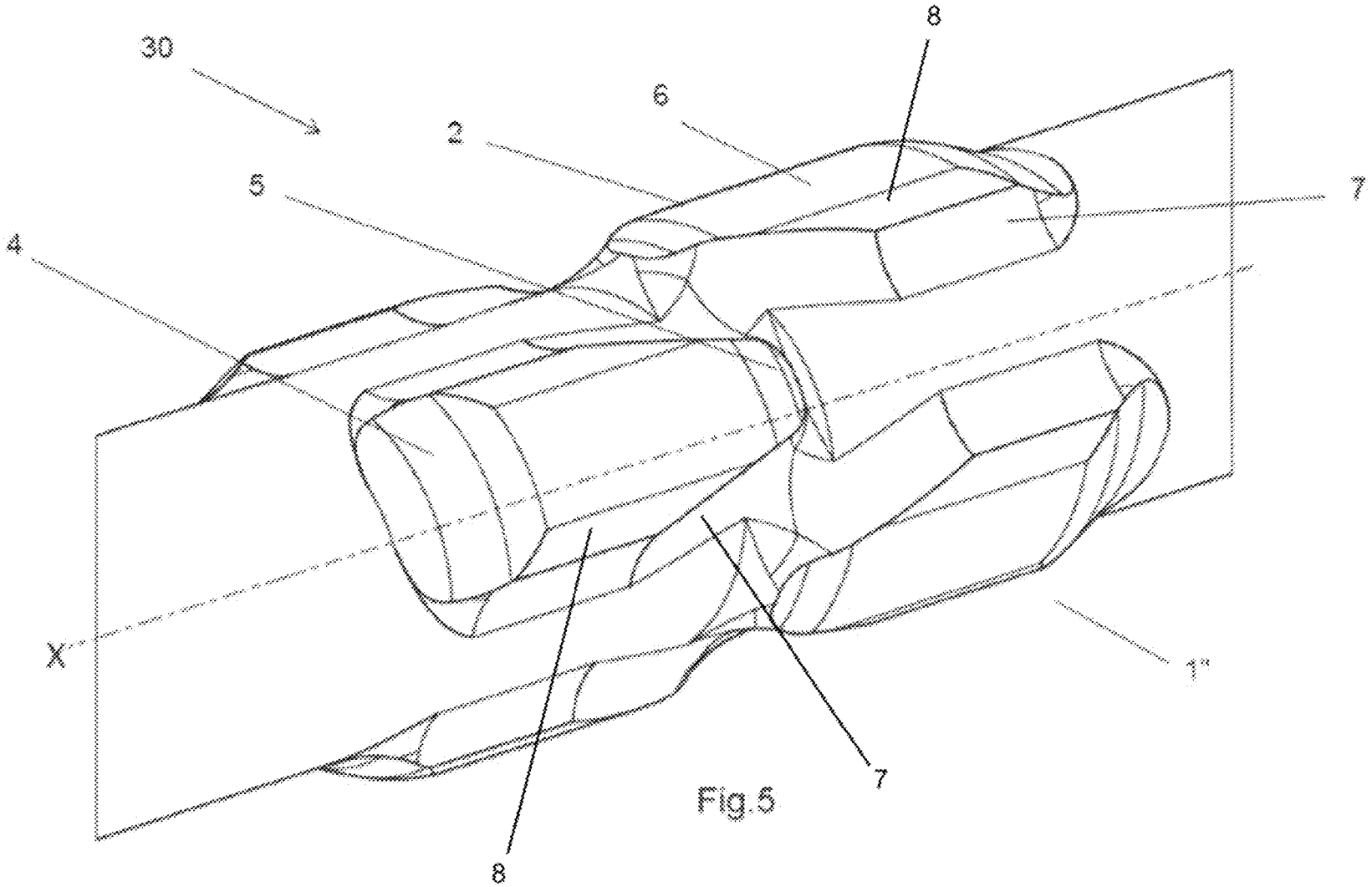
FIG. 5 is a perspective view of a monolithic stabiliser tool according to the invention.
Figure 6:
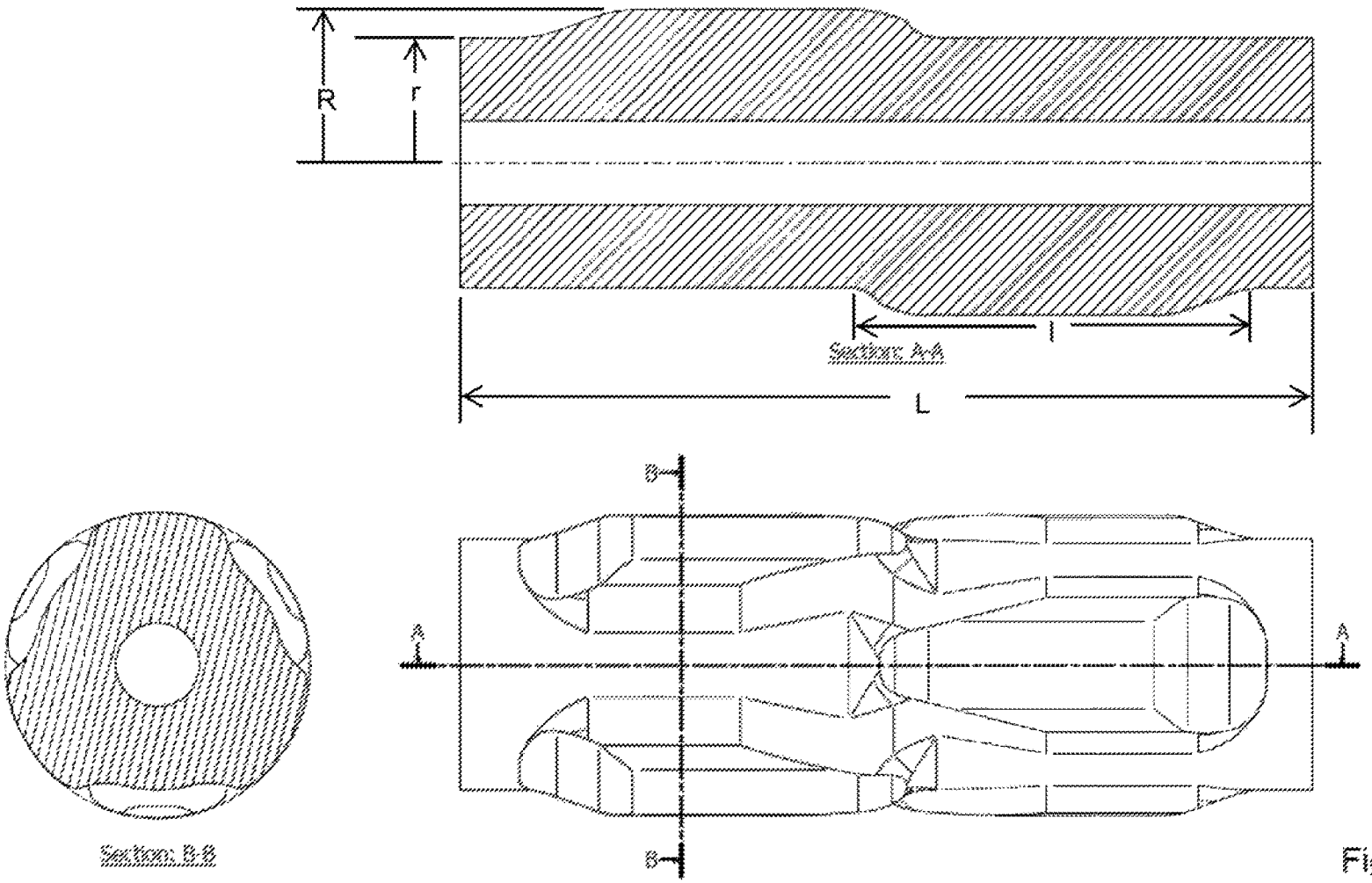
FIG. 6 are planar views of a monolithic stabiliser tool according to the invention.

A stabiliser tool according to the invention is shown in FIG. 5 and FIG. 6. Said stabiliser tool 30 comprises a cylindrical body part of radius r and length L defining a longitudinal axis X. The monolithic stabiliser tool 30 comprises three or more upper stabiliser blades 1" and three or more lower stabiliser blades. The blades 1" and the cylindrical body part are machined as an integral component forming in this way a monolithic blade stabiliser tool. The blades 1 extend radially outwardly from the surface of the cylindrical body part defining with their most outwardly extended surface an ideal cylinder coaxial with said cylindrical body part and having a radius R>r. The stabiliser blades 1" are preferably all of identical shape and we describe only one stabiliser blade. In this description we refer conventionally to the triangle-shaped part of the stabiliser blades as the back (or rear) section of the stabiliser blade only for ease of description, without giving any limiting meaning to these adjectives.

The stabiliser blade 1" according to the invention has an elongated shape with a length I, shorter than L, defining a longitudinal axis parallel to the axis of the monolithic stabiliser tool, with a front section 4, a back section 5, a central section, and vertical side walls 7. The upper surface 6 of the blade, having the shape of a dome, defines the contact area. The back section 5 tapers from the central section towards a substantially semi-circular back end, while the front section 4 has substantially the shape of a semi-circle. The upper surface 6 of the stabiliser blade 1" slopes downwards near and towards the end of the front section 4 and also near and towards the end of the back section 5 till it meets the surface of the cylindrical body part of the monolithic stabiliser tool. The stabiliser blade has the overall shape of a wing. Preferably, all edges 8 between the side vertical walls and the upper surface are rounded and similarly a rounding of the edges of all other walls having a border with the upper surface is also performed.

In the embodiment described in FIGS. 5 and 6 six stabiliser blades are machined in an axially aligned manner on the cylindrical surface of the cylindrical body part. A first group of three stabiliser blades have their centers arranged and equally distributed on a first circle on said cylindrical surface and a second group of three stabiliser blades have their centers arranged and equally distributed on a second circle, which second circle is spaced apart from the first circle. The front ends 4 on both circles extend in opposite directions, away from both circles, such that the front area of the forward moving stabiliser tool is provided with the wider front ends 4 of the stabiliser blades 1", irrespective of the direction in which the drilling string is being moved. The back sections of the two groups of stabiliser blades 1" are arranged in between each other, where the back ends 5 reach, in axial direction, approximately towards the centers of the neighboring stabiliser blades 1". Thereby oblique channels are formed between the back halves of each neighboring pair of stabiliser blades 1", defining the free flow area between the blades.

The stabiliser blades—three or more upper and three or more lower—are suitably positioned to optimise the hydrodynamic efficiency of the tool. This arrangement assists in streamlining the mud flow around the stabiliser blades, minimising the restriction of cuttings being carried out of the hole and enhancing hole cleaning, while maintaining all round centralisation of the bottom hole assembly in the borehole.

The shape of the stabiliser blades is such that they efficiently displace the drilling fluids and drilling cutting around the stabiliser blades, and greatly reduce the balling up and packing off of the stabiliser tool with drilled cuttings.

The tapered shape of the stabiliser blades reduce friction, and enhance the stabilisers performance while sliding in the oriented mode.

The function of the cross sectional taper of the blade is to reduce rotary torque and minimise undercutting when drilling in the rotary mode.

The toe and heel angle of the stabilised blades are preferably machined at approximately 20 degrees to minimise hanging-up and reduce up and down drag in the borehole.

Flow paths can be milled into the cylindrical body to create a self-cleaning and jetting effect, accelerating cuttings transportation over the cylindrical body upset area. The self-cleaning action, i.e. the jet effect, has shown minimised mud build up, homogeneous drilling fluid flow, and minimised balling up.

Figure 7:
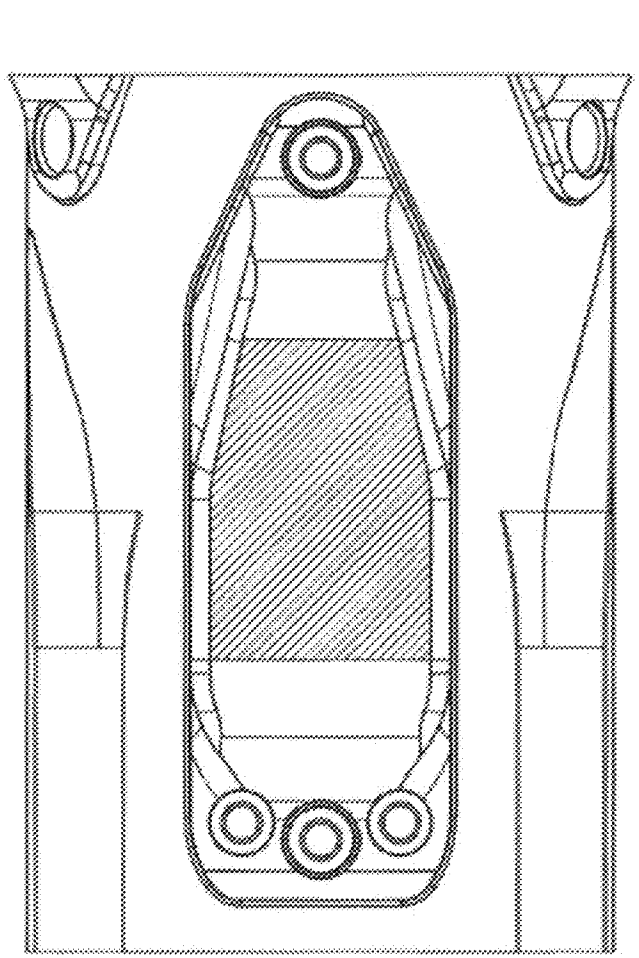
FIG. 7 shows a comparison regarding the surface contact area between the monolithic stabiliser tool according to the invention and the one with replaceable blades represented in FIG. 3.
Figure 7:
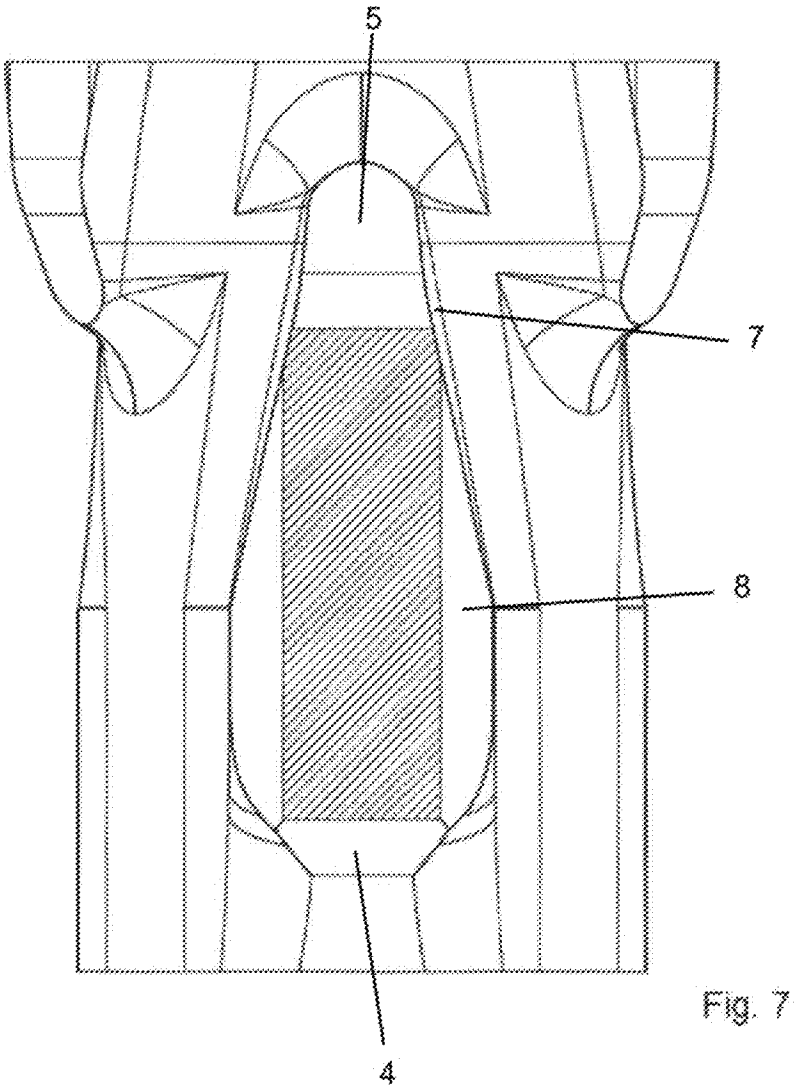

The monolithic stabiliser blade has a large surface contact area, greater than the surface contact area of the state-of-the-art stabiliser tool with replaceable blades resulting in an improved stability. FIG. 7 shows two stabilizer tools having the same diameter, the one on the left representing a monolithic stabiliser according to the invention, while the stabiliser tool on the right represents a stabiliser having replaceable blades, like the one of FIG. 3. The surface contact area are shown as shadow lines. From the figure it is possible to see that the surface contact area of the blade of the monolithic stabiliser tool is greater than the surface contact area of the replaceable blade.

Figure 1:
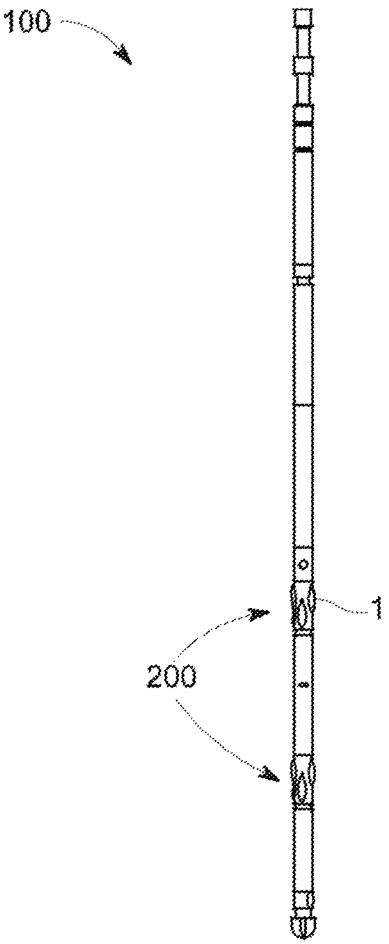
FIG. 1 (Prior Art)
FIG. 1 is a schematic drawing of a drilling assembly (bottom hole assembly)
Figure 3:
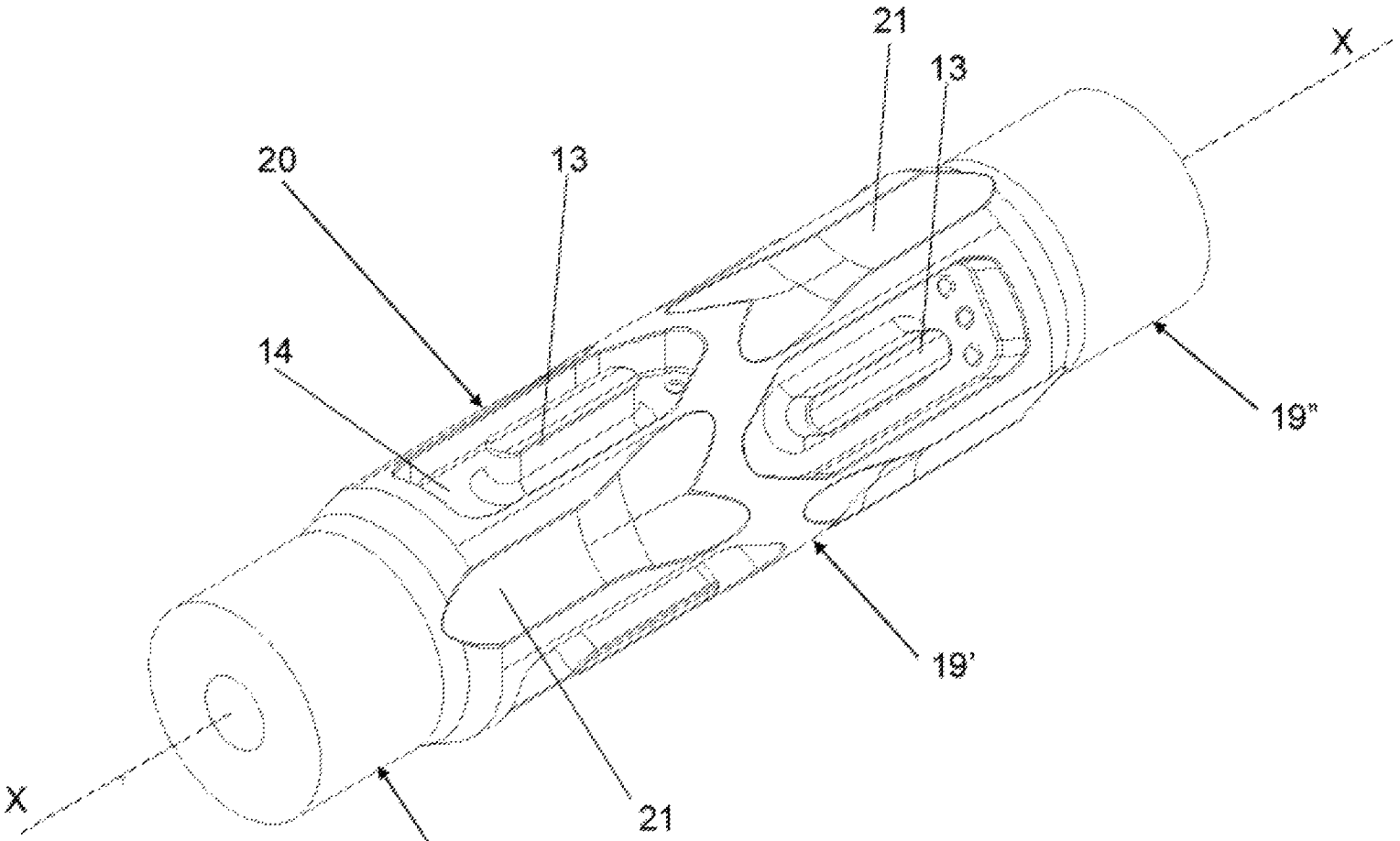
Fig.3 (Prior Art)
FIG. 3 is a perspective view of a stabiliser tool showing the grooves for mounting a monolithic type of stabiliser blade.
Figure 4:
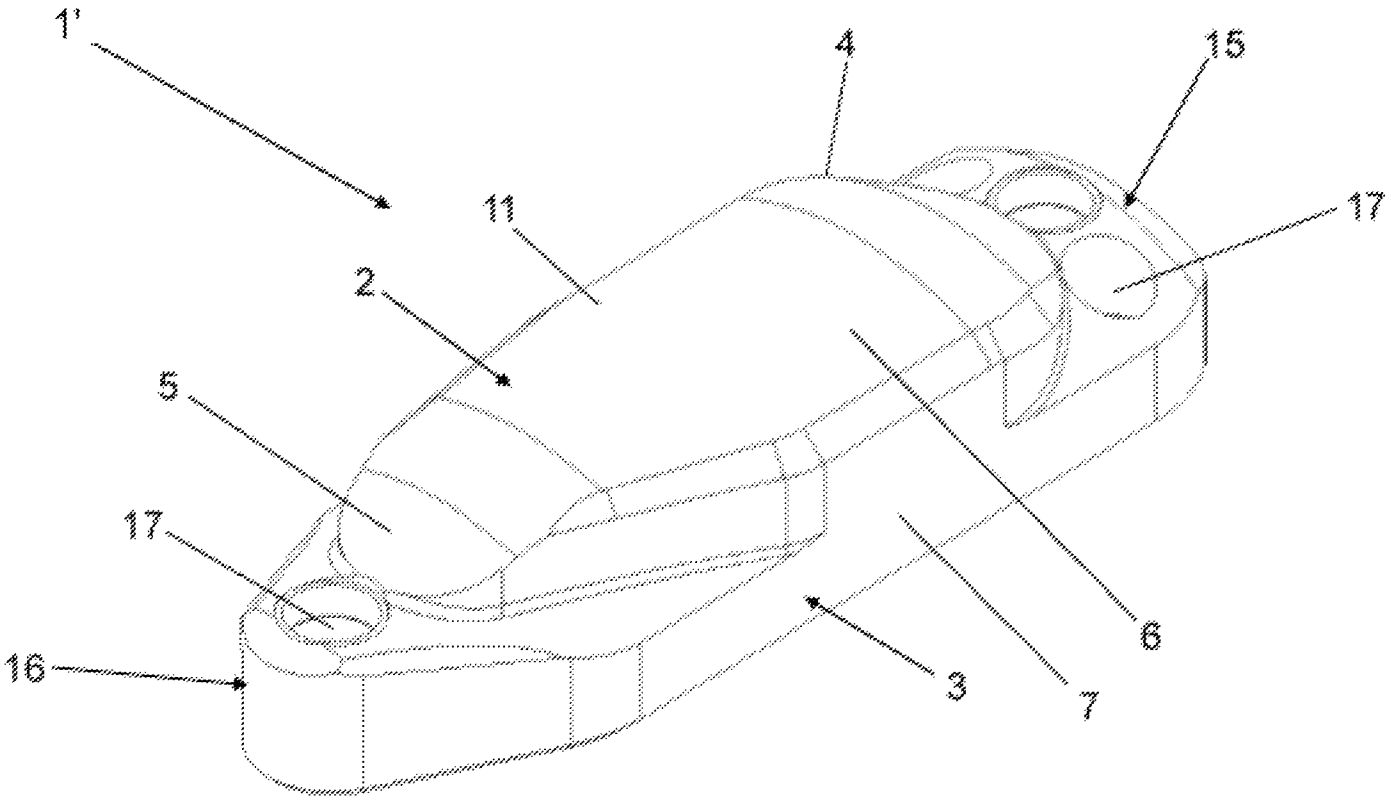
Fig.4 (Prior Art)
FIG. 4 is a perspective view of a monolithic blade to be mounted on the stabiliser tool of FIG. 3.
Figure 8:
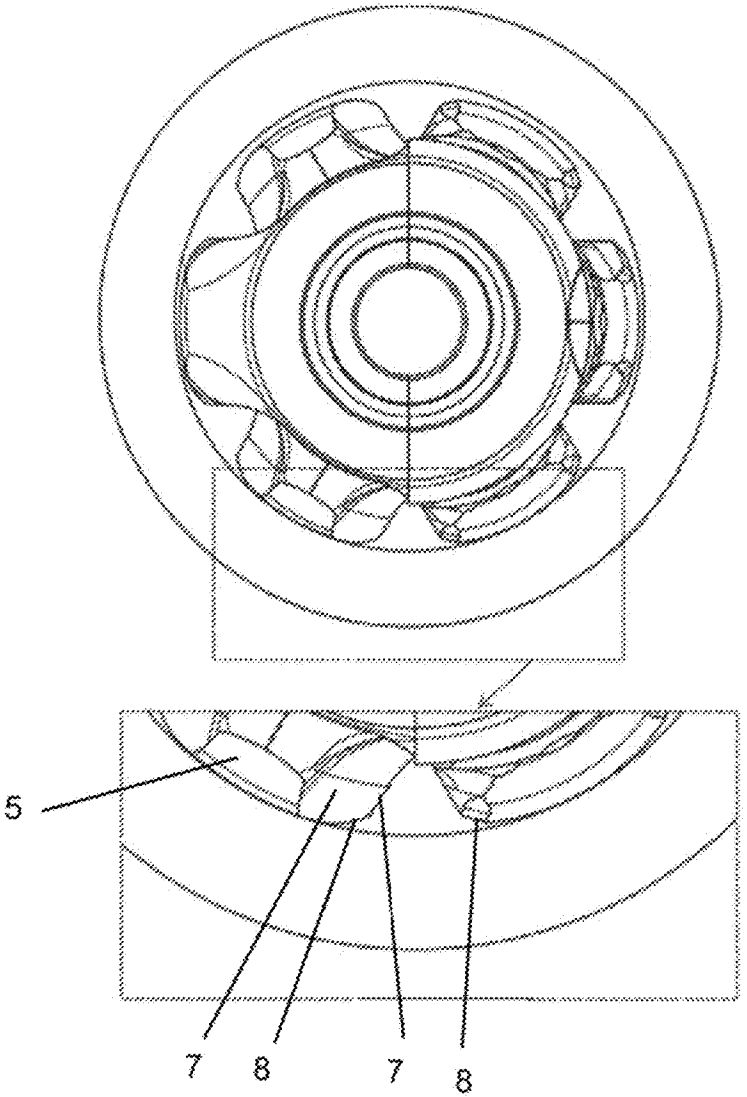
FIG. 8 shows details of the contact line for the monolithic stabiliser tool according to the invention and for the one with replaceable blades represented in FIG. 3.

FIG. 8 shows a more detailed comparison between the monolithic stabiliser tool depicted in the left hand side of the figure and the replaceable blade stabiliser tool of FIG. 3, depicted in the right hand side. The contact line is longer in the current invention (monolithic design) than the one of the stabiliser tool with replaceable blades of FIG. 3. This feature is expected to improve stabilisation. At the same time the available opening for mud/cuttings to flow is larger in the current invention, improving the hydrodynamics further as compared to the replaceable blades stabiliser tool.

In wells that do not have an adequate hole cleaning further accumulation of cuttings can occur. This is common in directional or horizontal wells. Increasing circulating pressure while drilling, or increase in drag when tripping are indications of a problem. In the current invention, the monolithic construction allows a better flexibility in choosing the value of the free flow area, also called the flow-by-area, which is an important design parameter. This flexibility feature may be advantageous in specific applications, such as in almost horizontal drilling, where as long as the bypass area is greater than the cuttings bed area, then tripping without circulation is possible, allowing also small radius drill string stabiliser.

The flow-by-area should be 35% of the hole area for hole size of 10"⅝ (inches) and above, and 25% of the hole area for hole sizes below 10"⅝ (inches).

As soon as we decide on a relation between the flow-by-area, e.g. 55%, and the contact area, e.g. 45%, then the aim is to keep the flow-by-area as constant as possible.

In FIG. 9 the graph shows the relation between the flow-by-area of a replaceable blade stabiliser tool (the one depicted in FIG. 3) and the monolithic one of the present invention. The elimination of the mounting components in the monolithic stabiliser tool allows better results in term of constancy of the flow-by-area. From the graph it results a flow-by-area that is constant within 10% of the mean value.

Whereas the invention is described by way of a preferred embodiments, the man skilled in the art will appreciate that modifications can be made within the scope of the invention as defined by the claims.

The invention claimed is:

1. A monolithic blade stabiliser tool (30) for a drilling string comprising a cylindrical body part of radius (r) and a length (L) defining a longitudinal axis (X) and comprising a plurality of stabiliser blades (1"), wherein said stabiliser blades (1") and said cylindrical body part are machined as an integral component defining a monolithic blade stabiliser tool, said stabiliser blades (1") extending radially outwardly from a surface of said cylindrical body part, and defining with their most outwardly extended surface an ideal cylinder coaxial with said cylindrical body part and having a radius (R), wherein R>r; each of said stabiliser blades (1") having an elongated shape extending parallel to said longitudinal axis (X) and having a length (I), wherein I<L; each of said stabiliser blades (1") comprising a front section (4), a back section (5) and a central section, an upper surface (6) having the shape of a dome defining a contact area, and vertical side walls (7), wherein said back section (5) tapers from said central section towards a substantially semi-circular back end and the front section (4) has substantially the shape of a semicircle, and wherein said upper surface (6) of the stabiliser blades slopes downwards near and towards the end of the front section (4) and also near and towards the end of the back section (5) till the upper surface (6) meets the surface of said cylindrical body part, each stabiliser blade including opposite rounded edges (8) between the vertical side walls (7) and the upper surface (6) beginning adjacent the front section (4) and moving toward the back section (5) and each rounded edge (8) terminating such that the contact area of the upper surface (6) and each vertical side wall (7) shares a respective common edge adjacent to the back section (5).

2. The monolithic blade stabiliser tool according to claim 1, wherein centers of said stabiliser blades are located along at least two coaxial spaced apart circles on the surface of said cylindrical body.

3. The monolithic blade stabiliser tool according to claim 2, wherein the plurality of stabiliser blades include more than three stabiliser blades and along each ideal cylinder there are placed at least a group of three stabiliser blades.

4. The monolithic blade stabiliser tool according to claim 3, wherein the average width of the front section of said stabiliser blades is substantially greater than the average width of the back section of said stabiliser blades.

5. The monolithic blade stabiliser tool according to claim 4, wherein front ends of each of said stabiliser blades on both cylinders extend in opposite directions, away from both cylinders.

6. The monolithic blade stabiliser tool according to claim 5, wherein the back section of the two groups of stabiliser blades are arranged in between each other such that oblique channels are formed between the back sections of each neighboring pair of stabiliser blades, defining a flow-by-area between the blades.

7. The monolithic blade stabiliser tool according to claim 6, wherein the flow-by-area is constant within 10% of its mean value.

* * * * *